US012297705B1

(12) United States Patent
Wang et al.

(10) Patent No.: US 12,297,705 B1
(45) Date of Patent: May 13, 2025

(54) SUPPORT MECHANISM OF SELF-ADAPTIVE TRACTION ROBOT FOR COMPLEX WELLBORE AND CONTROL METHOD THEREOF

(71) Applicant: Chengdu University of Technology, Chengdu (CN)

(72) Inventors: Xingming Wang, Chengdu (CN); Qiaozhu Wang, Chengdu (CN); Qingyou Liu, Chengdu (CN); Haiyan Zhu, Chengdu (CN); Xuelian Dong, Chengdu (CN); Yuanyuan Yang, Chengdu (CN); Jingran Tang, Chengdu (CN); Luqing Li, Chengdu (CN)

(73) Assignee: Chengdu University of Technology, Chengdu (CN)

( * ) Notice: Subject to any disclaimer, the term of this patent is extended or adjusted under 35 U.S.C. 154(b) by 0 days.

(21) Appl. No.: 18/939,678

(22) Filed: Nov. 7, 2024

(30) Foreign Application Priority Data

Jan. 5, 2024 (CN) ..... 202410014347.5

(51) Int. Cl.
*E21B 23/00* (2006.01)
*E21B 23/03* (2006.01)
(Continued)

(52) U.S. Cl.
CPC ..... *E21B 23/001* (2020.05); *E21B 23/03* (2013.01); *E21B 23/042* (2020.05); *E21B 47/06* (2013.01)

(58) Field of Classification Search
CPC ..... E21B 23/001; E21B 23/042; E21B 23/03
See application file for complete search history.

(56) References Cited

U.S. PATENT DOCUMENTS 6,752,175 B1 6/2004 Willschuetz
8,651,177 B2 * 2/2014 Vail, III ..... E21B 47/01 166/177.6
(Continued)

FOREIGN PATENT DOCUMENTS

CN 202371380 U 8/2012
CN 102954314 A 3/2013
(Continued)

OTHER PUBLICATIONS

Yulian Chang et al. "Down Hole Robot Walking for Detecting Oil. Well Fault Based" «Journal of System Simulation» Nat Med, vol. 20, Issue 13, Jul. 2008(Jul. 2008).
(Continued)

*Primary Examiner* — Shane Bomar
(74) *Attorney, Agent, or Firm* — Birchwood IP

(57) ABSTRACT

The present invention discloses a support mechanism of a self-adaptive traction robot for a complex wellbore and a control method thereof, and relates to the technical field of oil and gas field development. Each support link assembly in a support mechanism is controlled by an independent hydraulic cylinder and hydraulic valve. When a well wall that each support link assembly contacts in a circumferential direction is irregular, the support mechanism contact effect is not ideal, which leads to a decrease in traction force. In this case, a displacement sensor in a telescopic mechanism detects that a displacement of a traction cylinder piston is small, which is fed back to a ground control system, and then a fluid inflow size of support cylinders corresponding to different support link assemblies is adjusted until the displacement sensor in the telescopic mechanism detects an effective traction distance.

4 Claims, 9 Drawing Sheets

(51) Int. Cl.
*E21B 23/04* (2006.01)
*E21B 47/06* (2012.01)

(56) References Cited

U.S. PATENT DOCUMENTS

| | | | | |
|---|---|---|---|---|
| 8,770,303 | B2 * | 7/2014 | Aguirre | E21B 17/1078 166/381 |
| 9,097,086 | B2 * | 8/2015 | AlDossary | E21B 23/14 |
| 9,133,673 | B2 * | 9/2015 | Hill | E21B 23/042 |
| 11,668,148 | B1 * | 6/2023 | Dong | E21B 23/0412 166/250.01 |
| 2003/0024710 | A1 | 2/2003 | Post | |
| 2008/0066963 | A1 | 3/2008 | Sheiretov | |
| 2008/0128128 | A1 | 6/2008 | Vail | |
| 2008/0308318 | A1 * | 12/2008 | Moore | E21B 4/18 175/51 |
| 2013/0062075 | A1 | 3/2013 | Brennan | |
| 2018/0223615 | A1 | 8/2018 | Luke | |
| 2020/0181994 | A1 * | 6/2020 | Liu | E21B 34/066 |
| 2024/0360733 | A1 * | 10/2024 | Zhao | E21B 47/09 |
| 2024/0416474 | A1 * | 12/2024 | Ren | B24B 5/185 |

FOREIGN PATENT DOCUMENTS

| | | | |
|---|---|---|---|
| CN | 105822868 | A | 8/2016 |
| CN | 107477306 | B | 12/2017 |
| CN | 112014221 | B | 12/2020 |
| CN | 114370233 | A | 4/2022 |
| CN | 114961608 | B | 8/2022 |
| CN | 114704228 | B | 4/2023 |
| DE | 000003506185 | C2 | 8/1986 |
| EA | 202091969 | B1 | 2/2022 |
| JP | 2011106529 | B2 | 6/2011 |
| KR | 100863263 | B1 | 10/2008 |
| WO | 2023198087 | A1 | 10/2023 |

OTHER PUBLICATIONS

Hanxiu Peng et al. "Development and Performance Evaluation of the Electro-Hydraulic Control System of a Telescopic Downhole Robot" «Petroleum Drilling Techniques» Nat Med, vol. 51, Issue 3, May 2023(May 2003).

* cited by examiner

SUPPORT MECHANISM OF SELF-ADAPTIVE TRACTION ROBOT FOR COMPLEX WELLBORE AND CONTROL METHOD THEREOF

CROSS-REFERENCE TO RELATED APPLICATIONS

This application claims priority to Chinese Patent Application No. 202410014347.5, filed on Jan. 5, 2024, which is hereby incorporated by reference in its entirety.

TECHNICAL FIELD

The present invention relates to the technical field of oil and gas field development, and in particular, to a support mechanism of a self-adaptive traction robot for a complex wellbore and a control method thereof.

BACKGROUND

A downhole tractor is a downhole crawler, also called a downhole crawling mechanism, a downhole tractor, a downhole traction robot, a downhole hydraulic booster, a downhole propeller, and the like. The downhole tractor is a downhole tool that can provide traction force at the bottom of a well. The current traction robots mainly include a wheeled traction robot, a spiral traction robot, and a hydraulic traction robot. The contact and support between a wheeled traction robot and a well wall/pipe wall are achieved by driving wheels. A kinematic pair when the driving wheels support the well wall/pipe wall is a high pair, and a contact type is point contact. When the driving wheels support the well wall/pipe wall, it is also necessary to complete rolling to achieve the function of pipe string traction. In this case, due to poor contact effect, insufficient traction force or slippage is easy to occur, making the support effect and traction effect unsatisfactory. When the driving wheels of the wheeled traction robot support the well wall/pipe wall, the driving wheels are distributed on two sides of the robot in a circumferential direction and work in the same plane, and when the robot moves, the robot is easy to overturn in a circumferential direction due to slippage and small contact surface. The existing downhole tractor also has the following specific technical defects: a support mechanism of the traction robot can adapt to tiny rough bulges on the well wall; however, a support link assembly of the support mechanism is uniformly opened and closed, which cannot adapt well to the deformation of the wellbore and can only provide good support in the wellbore with a standard circular cross-section. If the contact effect between the support link assembly and the well wall/pipe wall is poor, when the robot support mechanism contacts the well wall to fix part of an operation nipple, the required friction force cannot be achieved, and when the robot support mechanism is difficult to efficiently assist in nipple traction for pipe string traction and can withstand small traction force, the improvement of the traction force of the robot is further limited, making it difficult to meet construction operation conditions with large traction force. As a direct component supporting the well wall, the driving wheel has a complex structure and precise dimensions, which makes processing, assembly and subsequent maintenance work difficult, and the processing of precision parts and the replacement of consumables greatly increase the operation cost.

The present invention with Chinese patent publication No. CN107477306B discloses an electro-hydraulic control system of a coiled tubing traction robot. The disclosed control system does not provide a detailed and specific description of execution structure characteristics and related motion state of the robot matched with the electro-hydraulic control system. In the electro-hydraulic control method and system of the robot, a hydraulic lock is not provided between a solenoid valve and an execution part (hydraulic cylinder), but a one-way valve is provided between a hydraulic pump and an oil circuit in the solenoid valve, which can only control the flow direction of liquid, but cannot lock the execution part, so that the execution part cannot be stopped at any position. In this technology, there is no high-precision micro sensor in the support link assembly, and the force of the support link assembly cannot be directly detected in real time; consequently, the support effect of the robot cannot be directly judged. The robot support mechanism involved in this technology also has problems such as the support mechanism cannot adapt to the deformation of the wellbore and the single support link assembly cannot be controlled separately.

SUMMARY

The present invention provides a control method of a support mechanism of a self-adaptive traction robot for a complex wellbore, which aims to solve the technical problems existing in the prior art.

To solve the above technical problems, the present invention adopts the following technical solutions.

A support mechanism of a self-adaptive traction robot for a complex wellbore includes a left operation nipple, a control nipple, a hydraulic nipple, and a right operation nipple. The left operation nipple and the right operation nipple are axially symmetrical relative to the control nipple and have the same structural function, and two ends of the control nipple are respectively connected to the left operation nipple and the right operation nipple. The left operation nipple includes a central main body, a support mechanism, a telescopic mechanism, and a hydraulic nipple, the support mechanism includes a support cylinder assembly and a support link assembly, the support cylinder assembly includes a support cylinder end cover, a support cylinder body, two or more than two pistons and piston rods, and a support cylinder partition, the support cylinder body includes support hydraulic chambers with the same number as pistons and piston rods and the same stroke and volume, a number of the support link assemblies is consistent with that of pistons and piston rods, the support cylinder partition is mounted in a groove in the support cylinder body, sealing rubber is distributed in the groove, and the support cylinder body is divided into a plurality of support hydraulic chambers with equal stroke and volume by the support cylinder partition. A piston and a piston rod are mounted on an end face of the support cylinder body in a matched mode, and a piston and a piston rod are mounted in each of the support hydraulic chambers. The support cylinder end cover is in threaded fit with an end face of the support cylinder body and is in contact with the support cylinder partition, so as to limit a position of the support cylinder partition.

Further, the support link assemblies are evenly arranged on the robot circumferentially, and each of the support link assemblies includes a short link base, a long link base, a first link, a support block, a second link, a third link, a support surface, and a pull rod. The short link base is in threaded connection with a part of a piston and a piston rod extending out of the support cylinder body, the short link base is hinged to the first link, the first link is hinged to the support block and the third link, the other end of the support block is hinged to the second link, the second link is hinged to a right end of the long link base, the third link is hinged to a left end of the long link base, the long link base is fixedly connected to the telescopic mechanism, and two ends of the pull rod are respectively fixed to the support cylinder body and the telescopic mechanism with threads. A micro pressure sensor is mounted in the support block.

Further, a plurality of oil channels are distributed in an annulus of the central main body, the central main body penetrates through the support mechanism, the telescopic mechanism, the control nipple, and the hydraulic nipple, the central main body is assembled with the support mechanism, and there is no relative sliding or rotation between the central main body and the support mechanism; a displacement sensor is arranged in the telescopic mechanism; the control nipple is equipped with a control circuit and wires, a micro motor, a hydraulic oil cylinder, two O-shaped middle-position functions for controlling the telescopic mechanism, a three-position four-way solenoid valve, and a hydraulic lock consisting of a plurality of one-way valves; and the hydraulic nipple is equipped with a plurality of O-shaped middle-position functions required by the support mechanism, a three-position four-way solenoid valve, a hydraulic lock consisting of a plurality of one-way valves, one micro hydraulic pump, one oil filter, and one relief valve.

A control method of a support mechanism of a self-adaptive traction robot for a complex wellbore includes the following steps:

S1: setting basic data, wherein the basic data includes an opening time and an action cycle of a solenoid valve, a starting threshold and a maximum threshold of a hydraulic cylinder in a support cylinder assembly, and an initial starting time coefficient of the solenoid valve;

S2: judging whether a pressure of the hydraulic cylinder in the support cylinder assembly reaches the maximum threshold, if not, proceeding to a next operation, and if so, ending the operation;

S3: collecting a pressure difference before and after each solenoid valve, and calculating and storing data of a piston stroke and thrust of the support cylinder assembly;

S4: fitting and calculating a derivative of a piston stroke-thrust curve according to the data of the piston stroke and thrust;

S5: judging whether a slope of the derivative of the piston stroke-thrust curve is less than C0, if so, indicating that a support link assembly and a wellbore wall are in a clearance stage, and if not, indicating that a support link assembly and a wellbore wall are in a contact state or a lifting stage;

S6: further judging whether a slope of the derivative of the piston stroke-thrust curve is less than C1, if so, indicating that a support link assembly and a wellbore wall are in a lifting stage, and if not, indicating that a support link assembly and a wellbore wall are in a contact state;

S7: adjusting a time coefficient of a hydraulic cylinder control cycle according to a state between each of the support link assemblies and the wellbore wall, that is, opening a corresponding solenoid valve for a specified time; and S8: calculating a thrust of the hydraulic cylinder, judging whether a target thrust has been reached, if not, returning to the step S2 and continuing subsequent steps until the target thrust is reached; if so, ending the control.

The specific method for fitting and calculating the derivative of the piston stroke-thrust curve in the S4 is as follows:

$$Q = C_v(p_w - p_{ci})\sqrt{\frac{\rho}{SG}},$$

wherein Q is a flow rate of the solenoid valve, $C_v$ is a coefficient of the solenoid valve, which is determined by an indoor experiment after the solenoid valve is processed, $p_w$ is a working pressure of a hydraulic system, $p_{ci}$ is a pressure of an $i^{th}$ hydraulic cylinder, ρ is a hydraulic oil density, and SG is a specific gravity of hydraulic oil; a calculation formula of a displacement of the hydraulic cylinder in one control cycle:

$$d_x = \frac{kQdt}{S},$$

wherein k is a time coefficient selected from k0, k1, and k2, dt is an opening time of the solenoid valve in a control cycle, dx is a displacement of a piston of the hydraulic cylinder in one control cycle, and S is an area of a piston of the hydraulic cylinder; and a calculation formula of a thrust of the hydraulic cylinder is as follows:

$$p_{ci} = \frac{F}{S},$$

wherein F is the thrust. According to the three formulas, the derivative of the piston stroke-thrust curve in a control cycle can be obtained.

The solenoid valve is driven by a PWM signal with a certain duty cycle, a position and a pressure of a piston of the hydraulic cylinder in a control cycle are measured, a thrust of the piston is further calculated, a state of each thrust hydraulic cylinder is judged according to the slope, and the time coefficients k0, k1, and k2 of the device are adjusted according to the state of each hydraulic cylinder, namely the duty cycle of the PWM is adjusted.

The slope C0 in the step S5 is a slope of the support mechanism under a no-load condition, and the main pressure loss is a flow friction of a hydraulic system in the support cylinder assembly and a friction force of the piston and the piston rod. Since the support mechanism has no load, a slope of a piston stroke-pressure curve is small in this case, the piston stroke-pressure data is recorded, the curve is drawn, and then the slope C0 is obtained by linear fitting. The slope C1 in the step S6 is a slope under the condition that the support mechanism contacts a hard well wall, the piston stroke change is small, and the oil cylinder pressure rises sharply; the slope of the piston stroke-pressure curve is large in this case, the support mechanism is fixed in a laboratory, a fixed iron plate is mounted in a stroke range of the support link assembly, when the support link assembly contacts the iron plate, the piston stroke-pressure data are recorded, the curve is drawn, and then the slope C1 is obtained by linear fitting.

Based on the above technical solution, the following technical effects may be produced:

(1) A support mechanism of a downhole traction robot provided by the present invention can adapt to an irregular cross-section of a wellbore caused by casing deformation, which further ensures that a support link assembly effectively contacts a pipe wall, and achieves maximization of pipe string supporting effect, so that the stability of the entire robot is effectively maintained when the robot performs pipe string traction operation, the pipe string and the robot move relative to each other, and the traction of the pipe string is achieved.

(2) The robot provided by the present invention has two or more support link assemblies in a single operation nipple, and each support link assembly is controlled by an independent hydraulic cylinder and an independent hydraulic valve. When a well wall that each support link assembly contacts in a circumferential direction is irregular, the support mechanism contact effect is not ideal, which leads to a decrease in traction force. In this case, a displacement sensor in a telescopic mechanism detects that a displacement of a traction cylinder piston is small, which is fed back to a ground control system, and then the fluid inflow size of the support cylinders corresponding to different support link assemblies is adjusted until the displacement sensor in the telescopic mechanism detects an effective traction distance, so that effective support and auxiliary traction of the robot support mechanism in various complex wellbores are achieved.

(3) A micro pressure sensor is arranged in the support mechanism, and an opening angle of each support link assembly is controlled by a corresponding hydraulic cylinder and hydraulic valve. The opening angle of each support link assembly may be different, which can adapt to different well walls and form good contact with the well walls. When a plurality of hydraulic cylinders operate independently, the corresponding hydraulic valves need to work in coordination. A plurality of hydraulic valves work in coordination to form a feedback mechanism with a support mechanism of an execution part to control an opening size and a flow rate of the hydraulic valve, thereby controlling the fluid inflow size of each support cylinder to control an extension length of the piston and piston rod and to effectively control an opening and closing angle of the support link assembly. Therefore, the precise contact with the well wall is achieved, and the support of the robot support mechanism is maximized.

The support mechanism of the present invention may also be used with a downhole tractor, a drilling robot and other downhole operation tools that have the function of pipe string traction to assist various downhole traction tools in operating efficiently.

Figure 1:
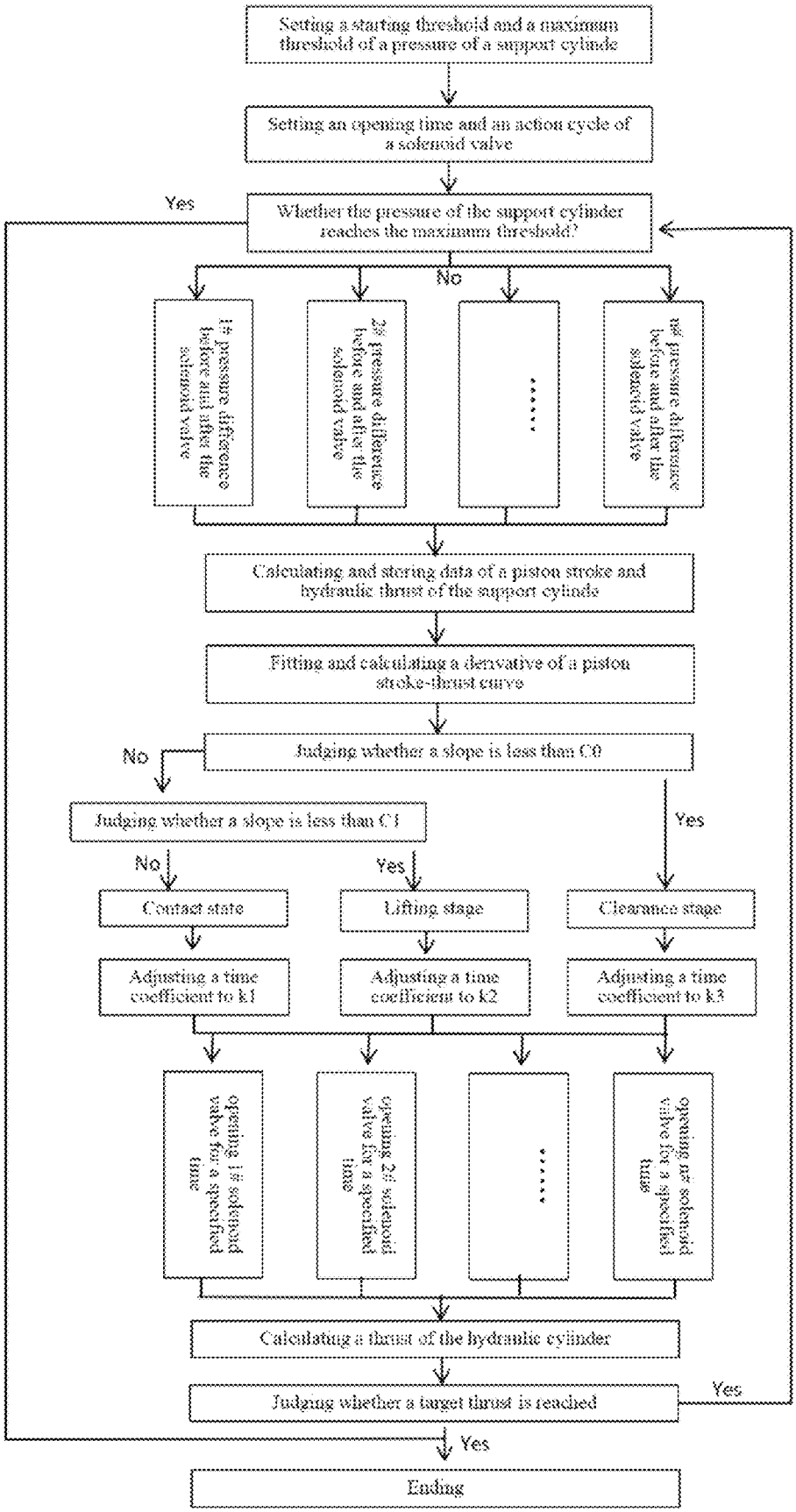
FIG. 1 is a control flow chart of the present invention.
Figure 2:
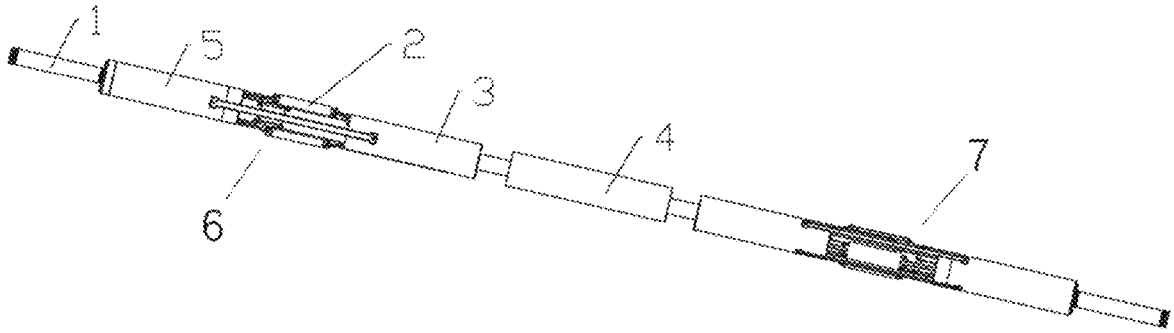
FIG. 2 is a schematic diagram of a structure of a self-adaptive traction robot according to the present invention.
Figure 3:
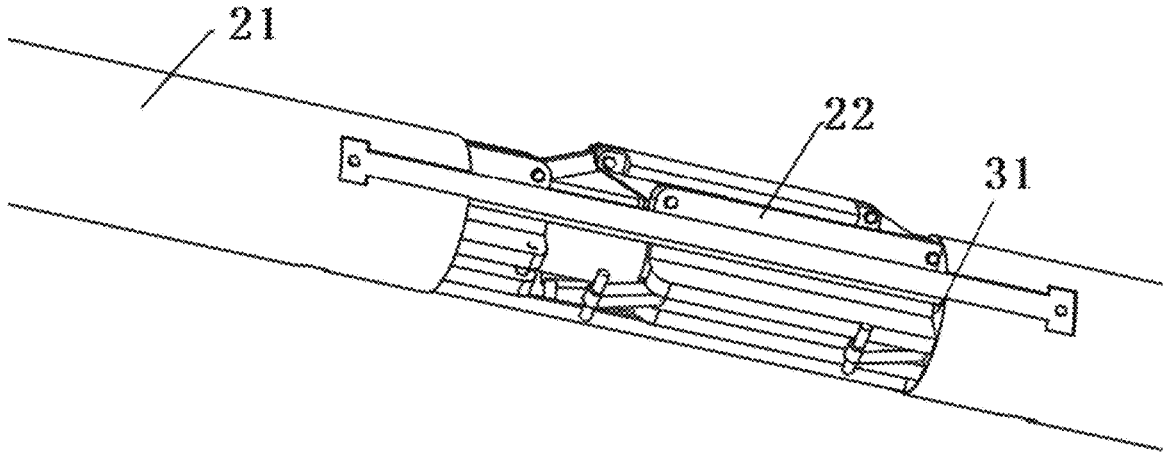
FIG. 3 is a schematic diagram of a support mechanism.
Figure 4:
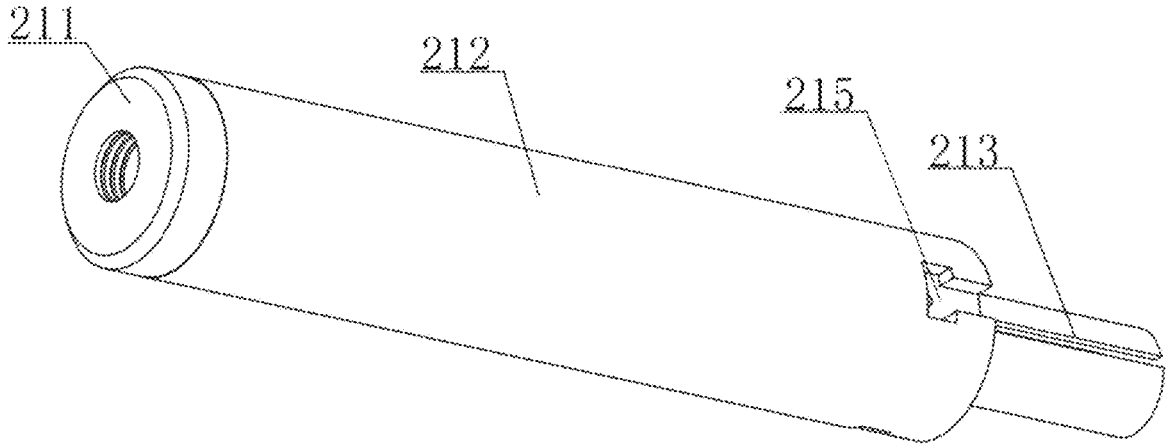
FIG. 4 is a schematic diagram of a structure of a support cylinder assembly.
Figure 5:
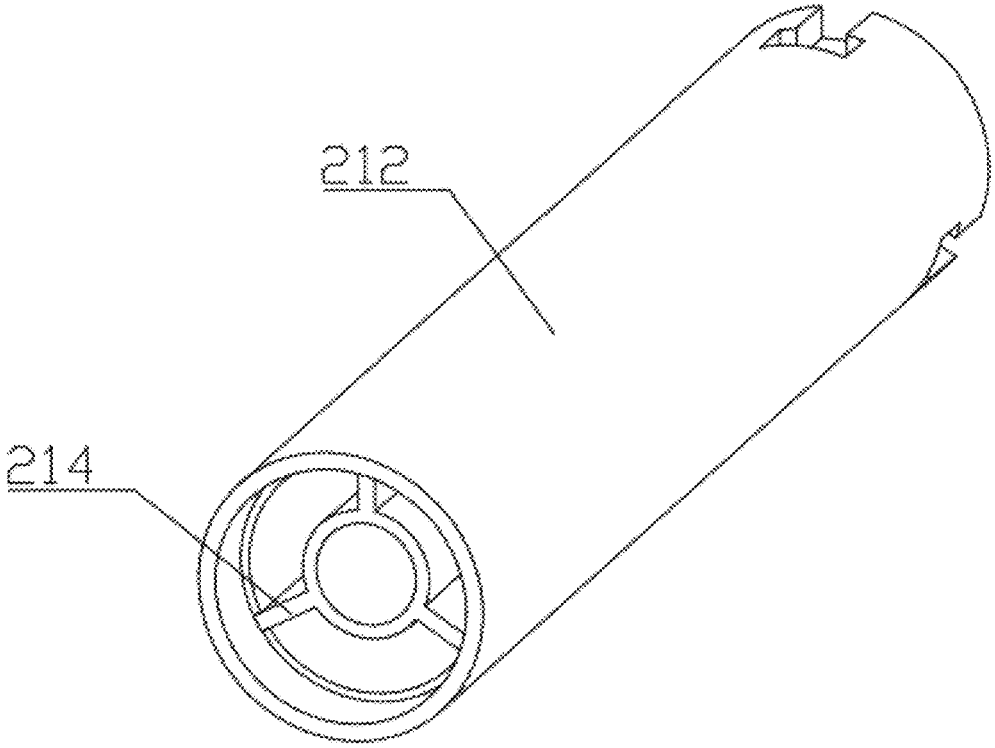
FIG. 5 is a schematic diagram of the assembly of a support cylinder body and a support cylinder partition.
Figure 6:
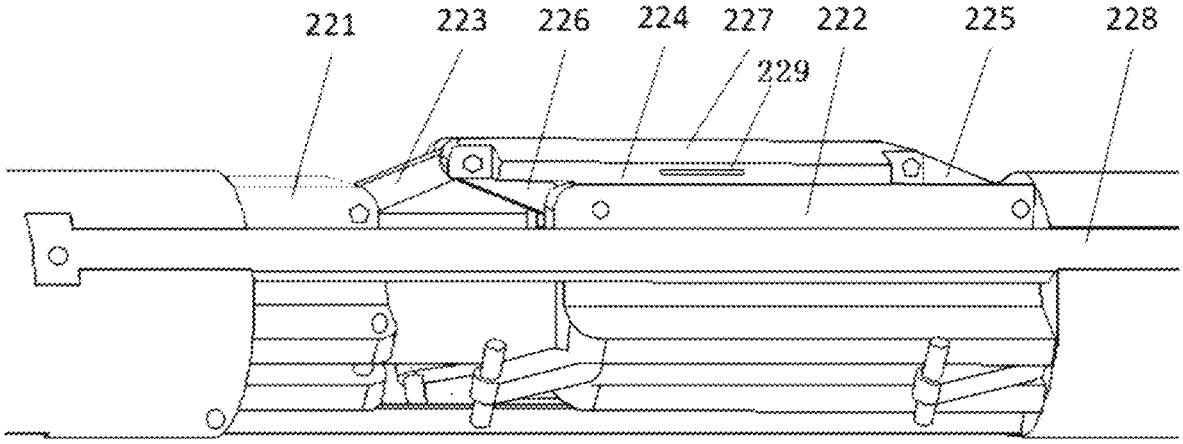
FIG. 6 is a schematic diagram of a structure of a support link assembly.

In the drawings: 1: central main body, 2: support mechanism, 3: telescoping mechanism, 4: control nipple, 5: hydraulic nipple, 6: left operation nipple, 7: right operation nipple, 11: oil channel, 21: support cylinder assembly, 22: support link assembly, 211: support cylinder end cover, 212: support cylinder body, 213: piston rod, 214: support cylinder partition, 215: piston, 216: support hydraulic chamber, 221: short link base, 222: long link base, 223: first link, 224: support block, 225: second link, 226: third link, 227: support surface, 228: pull rod, 229: micro pressure sensor, 31: displacement sensor, 41: micro motor and 42: hydraulic oil cylinder, 43: three-position four-way solenoid valve, 44: hydraulic lock, 51: micro hydraulic pump, 52: oil filter, and 53: relief valve.

DESCRIPTION OF EMBODIMENTS

It should be understood that the specific embodiments described herein are merely illustrative of the present invention and do not limit the present invention.

The following clearly and completely describes the technical solutions in embodiments of the present invention with reference to the accompanying drawings in embodiments of the present invention. It is clear that the described embodiments are merely a part rather than all of embodiments of the present invention. All other embodiments obtained by those of ordinary skill in the art based on embodiments of the present invention without creative efforts shall fall within the protection scope of the present invention.

As shown in FIGS. 1 to 6, 18, and 19, a support mechanism of a self-adaptive traction robot for a complex wellbore includes a left operation nipple 6, a control nipple 4, a hydraulic nipple 5, and a right operation nipple 7. The left operation nipple 6 and the right operation nipple 7 are axially symmetrical relative to the control nipple 4 and have the same structural function, and two ends of the control nipple 4 are respectively connected to the left operation nipple 6 and the right operation nipple 7. The left operation nipple 6 includes a central main body 1, a support mechanism 2, a telescopic mechanism 3, and a hydraulic nipple 5, the support mechanism 2 includes a support cylinder assembly 21 and a support link assembly 22, the support cylinder assembly 21 includes a support cylinder end cover 211, a support cylinder body 212, two or more than two pistons 215 and piston rods 213, and a support cylinder partition 214, the support cylinder body 212 includes support hydraulic chambers 216 with the same number as pistons 215 and piston rods 213 and the same stroke and volume, and a number of the support link assemblies 22 is consistent with that of pistons 215 and piston rods 213.

The support cylinder partition 214 is arranged in a groove in the support cylinder body 212, sealing rubber is distributed in the groove, and the support cylinder body 212 is divided into a plurality of support hydraulic chambers 216 with equal stroke and volume by the support cylinder partition 214; a piston 215 and a piston rod 213 are mounted on an end face of the support cylinder body 212 in a matched mode, and a piston 215 and a piston rod 213 are mounted in each of the support hydraulic chambers 216; and the support cylinder end cover 211 is in threaded fit with an end face of the support cylinder body 212 and is in contact with the support cylinder partition 214, so as to limit a position of the support cylinder partition 214.

The support link assemblies 22 are evenly arranged on the robot circumferentially, each of the support link assemblies 22 includes a short link base 221, a long link base 222, a first link 223, a support block 224, a second link 225, a third link 226, a support surface 227, and a pull rod 228, the short link base 221 is in threaded connection with a part of a piston 215 and a piston rod 213 extending out of the support cylinder body 212, the short link base 221 is hinged to the first link 223, the first link 223 is hinged to the support block 224 and the third link 226, the other end of the support block 224 is hinged to the second link 225, the second link 225 is hinged to a right end of the long link base 222, the third link 226 is hinged to a left end of the long link base 222, the long link base 222 is fixedly connected to the telescopic mechanism 3, and two ends of the pull rod 228 are respectively fixed to the support cylinder body 212 and the telescopic mechanism 3 with threads. A micro pressure sensor 229 is mounted in the support block 224.

A plurality of oil channels 11 are distributed in an annulus of the central main body 1, the central main body 1 penetrates through the support mechanism 2, the telescopic mechanism 3, the control nipple 4, and the hydraulic nipple 5, the central main body 1 is assembled with the support mechanism 2, and there is no relative sliding or rotation between the central main body 1 and the support mechanism 2; a displacement sensor 31 is arranged in the telescopic mechanism 3; the control nipple 4 is equipped with a control circuit and wires, a micro motor 41, a hydraulic oil cylinder 42, two O-shaped middle-position functions for controlling the telescopic mechanism 3, a three-position four-way solenoid valve 43, and a hydraulic lock 44 consisting of a plurality of one-way valves; and the hydraulic nipple 5 is equipped with a plurality of O-shaped middle-position functions required by the support mechanism 2, a three-position four-way solenoid valve 43, a hydraulic lock 44 consisting of a plurality of one-way valves, one micro hydraulic pump 51, one oil filter 52, and one relief valve 53.

A control method of a support mechanism of a self-adaptive traction robot for a complex wellbore includes the following steps:

S1: setting basic data, wherein the basic data includes an opening time and an action cycle of a solenoid valve, a starting threshold and a maximum threshold of a hydraulic cylinder in a support cylinder assembly 21, and an initial starting time coefficient of the solenoid valve;

S2: judging whether a pressure of the hydraulic cylinder in the support cylinder assembly 21 reaches the maximum threshold, if not, proceeding to a next operation, and if so, ending the operation;

S3: collecting a pressure difference before and after each solenoid valve, and calculating and storing data of a piston stroke and thrust of the support cylinder assembly 21;

S4: fitting and calculating a derivative of a piston stroke-thrust curve according to the data of the piston stroke and thrust;

S5: judging whether a slope of the derivative of the piston stroke-thrust curve is less than C0, if so, indicating that a support link assembly 22 and a wellbore wall are in a clearance stage, and if not, indicating that a support link assembly 22 and a wellbore wall are in a contact state or a lifting stage;

S6: further judging whether a slope of the derivative of the piston stroke-thrust curve is less than C1, if so, indicating that a support link assembly 22 and a wellbore wall are in a lifting stage, and if not, indicating that a support link assembly 22 and a wellbore wall are in a contact state;

S7: adjusting a time coefficient of a hydraulic cylinder control cycle according to a state between each of the support link assemblies 22 and the wellbore wall, that is, opening a corresponding solenoid valve for a specified time; and S8: calculating a thrust of the hydraulic cylinder, judging whether a target thrust has been reached, if not, returning to the step S2 and continuing subsequent steps until the target thrust is reached; if so, ending the control.

The specific method for fitting and calculating the derivative of the piston stroke-thrust curve in the S4 is as follows:

$$Q = C_v(p_w - p_{ci})\sqrt{\frac{\rho}{SG}},$$

wherein Q is a flow rate of the solenoid valve, $C_v$ is a coefficient of the solenoid valve, which is determined by an indoor experiment after the solenoid valve is processed, $p_w$ is a working pressure of a hydraulic system, $p_{ci}$ is a pressure of an $i^{th}$ hydraulic cylinder, ρ is a hydraulic oil density, and SG is a specific gravity of hydraulic oil; a calculation formula of a displacement of the hydraulic cylinder in one control cycle:

$$d_x = \frac{kQdt}{S},$$

wherein k is a time coefficient selected from k0, k1, and k2, dt is an opening time of the solenoid valve in a control cycle, dx is a displacement of a piston of the hydraulic cylinder in one control cycle, and S is an area of a piston of the hydraulic cylinder; and a calculation formula of a thrust of the hydraulic cylinder is as follows:

$$p_{ci} = \frac{F}{S},$$

wherein F is the thrust. According to the three formulas, the derivative of the piston stroke-thrust curve in a control cycle can be obtained.

The solenoid valve is driven by a PWM signal with a certain duty cycle, a position and a pressure of a piston of the hydraulic cylinder in a control cycle are measured, a thrust of the piston is further calculated, a state of each thrust hydraulic cylinder is judged according to the slope, and the time coefficients k0, k1, and k2 of the device are adjusted according to the state of each hydraulic cylinder, namely the duty cycle of the PWM is adjusted.

The slope C0 in the step S5 is a slope of the support mechanism 2 under a no-load condition, and the main pressure loss is a flow friction of a hydraulic system in the support cylinder assembly 21 and a friction force of the piston and the piston rod 213. Since the support mechanism 2 has no load, a slope of a piston stroke-pressure curve is small in this case, the piston stroke-pressure data is recorded, the curve is drawn, and then the slope C0 is obtained by linear fitting. The slope C1 in the step S6 is a slope under the condition that the support mechanism 2 contacts a hard well wall, the piston stroke change is small, and the oil cylinder pressure rises sharply; the slope of the piston stroke-pressure curve is large in this case, the support mechanism 2 is fixed in a laboratory, a fixed iron plate is mounted in a stroke range of the support link assembly 22, when the support link assembly 22 contacts the iron plate, the piston stroke-pressure data are recorded, the curve is drawn, and then the slope C1 is obtained by linear fitting.

In this embodiment, three pistons and piston rods 213 are used for illustration. The working principle of the present invention is described below in conjunction with the accompanying drawings.

Since each support link assembly 22 of the support mechanism 2 of the traction robot is provided with a corresponding support cylinder assembly 21 to work in coordination, an included angle formed by expansion of the links in each support link assembly 22 (namely the expansion degree of the links) may be controlled in a matching way according to the coordination of the corresponding support cylinder assembly 21 and the support link assembly 22. The expansion degree of each group of links can be the same or different, and the support arms can be better attached to different well walls.

Figure 7:
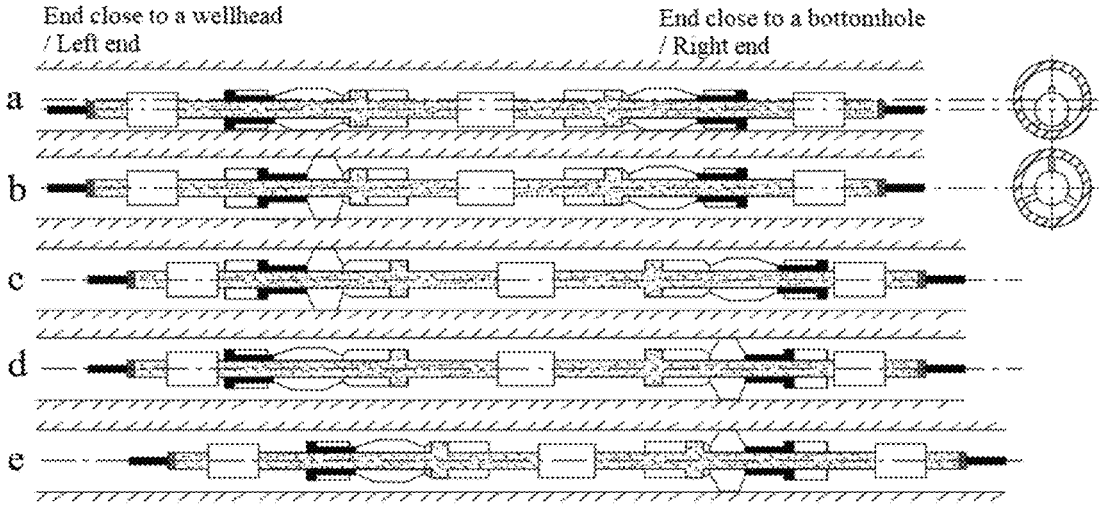
FIG. 7 is a schematic diagram of the working of a self-adaptive traction robot in an ideal wellbore under the action of a support mechanism.

When a wellbore or a casing is in an ideal state in which there is no obvious deformation or damage in a cross section, and the well wall is smooth and free of protrusions, the movement principle of the traction robot is as shown in FIG. 7.

Figure 10:
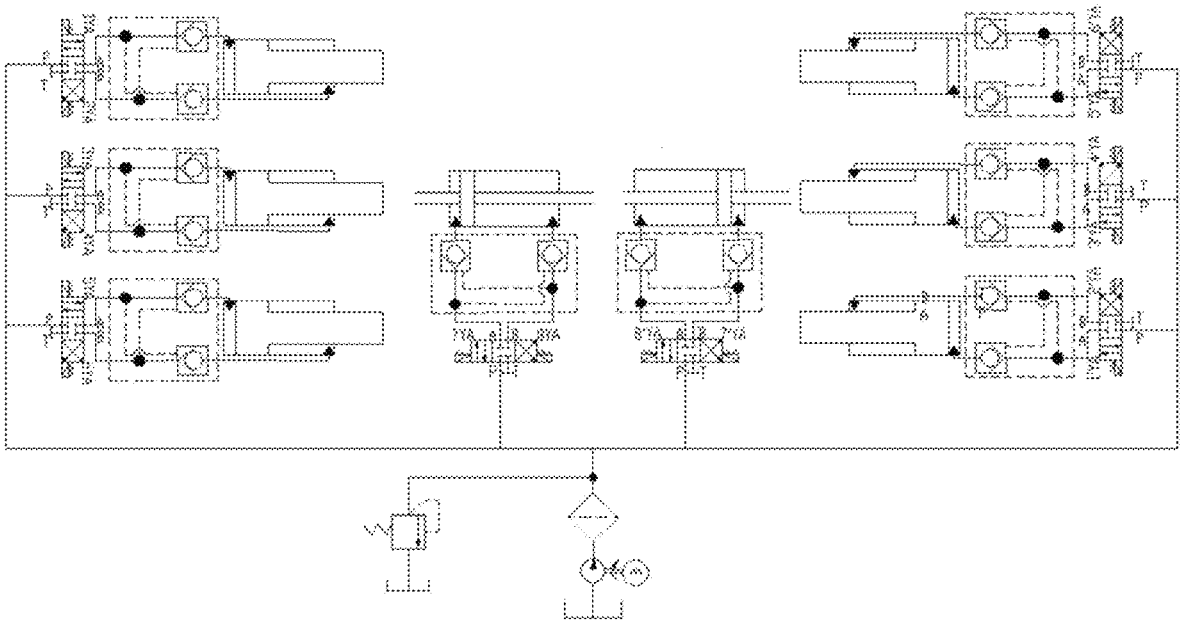
FIG. 10 is a hydraulic principle diagram of a self-adaptive traction robot in state a, state a', or state b'.

State a: When the robot is stationary in the non-straight section of the wellbore, the support mechanism 2 of the traction robot is in a reset state. A piston and a piston rod 213 of a left support cylinder of a left support mechanism 2 in a left operation nipple are positioned at a left end of a left support cylinder body 212, and a right end of the left support cylinder body 212 is empty to provide a chamber for hydraulic oil; a left side is tightened as the piston and the piston rod 213 of the support cylinder are placed to the left, and then the entire support link assembly 22 is in a tightened state. A left hydraulic cylinder in a left telescopic mechanism 3 is placed right at a hydraulic cylinder piston fixed to a central main body 1, and two control nipples 4 are connected to the central main body 1 of two operation nipples without relative sliding and rotation. The right operation nipples are symmetrically distributed for the control nipple 4, and have the same function and working principle. In this case, when the support mechanism 2 of the robot is reset, a robot hydraulic control system is as shown in FIG. 10: the three-position four-way solenoid valves of all the cylinder bodies are in a middle position function.

Figure 11:
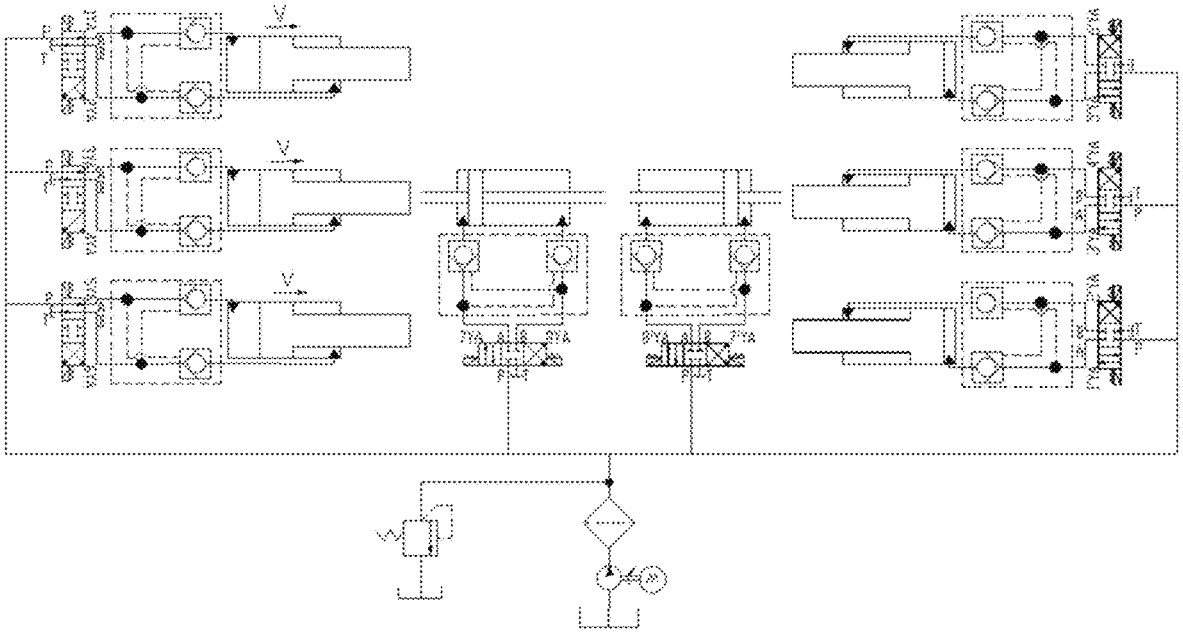
FIG. 11 is a hydraulic principle diagram of a self-adaptive traction robot in state b.

State b: A left support mechanism 2 in the left operation nipple is operating. The solenoid valves in the control nipple 4 work simultaneously, and control hydraulic oil to enter a plurality of chambers of the left support cylinder body 212 of the left operation nipple along a plurality of oil inlets, so that pistons and piston rods 213 of a plurality of left support cylinders are pushed to move rightwards by the same stroke simultaneously. In this case, two or more support link assemblies 22 are opened under the movement of a piston and a piston rod 213 of a correspondingly connected left support cylinder, the opening degree of the first links 223 in each support link assembly is the same, and a plurality of left support blocks 224 are in close contact with the well wall or the casing wall. In this case, the support function of the left support mechanism 2 of the traction robot may be regarded as lifting off the well wall/pipe wall surface. Due to the friction force generated by the close contact between the support block 224 and the well wall/pipe wall, the left operation nipple of the traction robot (except the central main body 1) is fixed in the current position and remains unchanged relative to the wellbore. The robot hydraulic control system in this case is as shown in FIG. 11: a hydraulic pump is started, meanwhile, the left positions 1YA, 3YA, and 5YA of 3 three-position four-way solenoid valves in the hydraulic nipple 5 are powered on simultaneously, hydraulic oil flows into a corresponding support cylinder body 212 through the port A of the solenoid valve P along the oil channel 11 of the central main body 1; in this case, the left chamber of the left support cylinder body 212 is filled with hydraulic oil, so that the piston and the piston rod 213 of the left support cylinder move rightwards simultaneously to drive the support link assembly 22 to move until the support block 224 is in close contact with the well wall, and the hydraulic oil in the support cylinder body 212 enters through the port B of the solenoid valve along the oil channel 11 and flows back to the oil cylinder from the port T.

Figure 12:
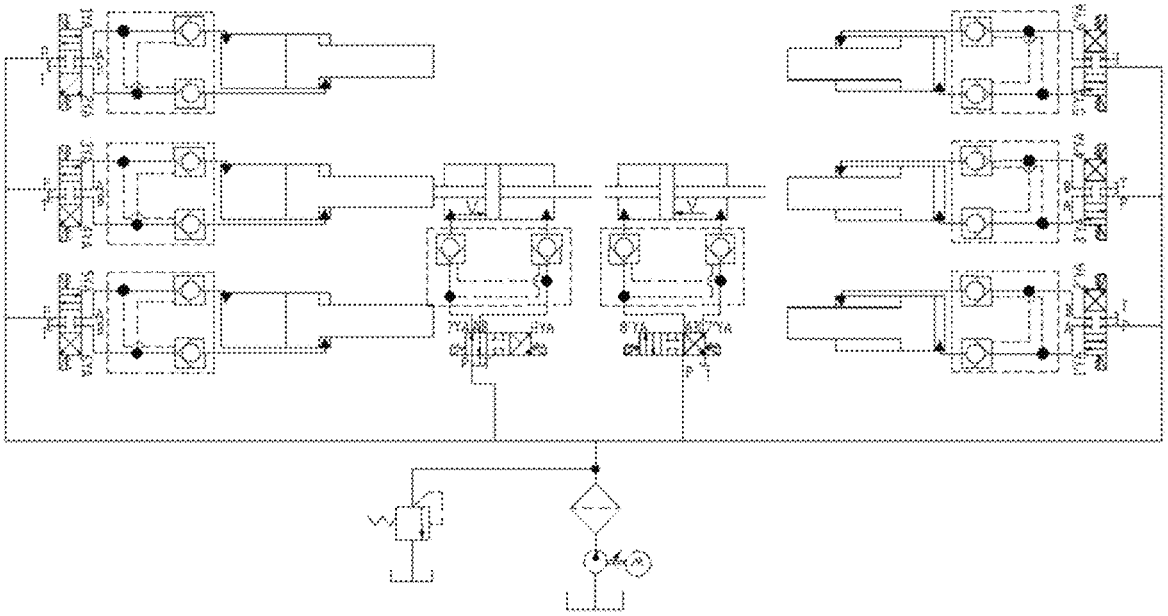
FIG. 12 is a hydraulic principle diagram of a self-adaptive traction robot in state c.

State c: With the assistance of the left support mechanism 2, the robot performs the first traction operation. When the left support mechanism 2 performs support operation, solenoid valves for controlling left and right telescopic mechanisms 3 in the control nipple 4 start to work simultaneously; hydraulic oil flows into a left chamber of a left hydraulic cylinder body through an oil channel to push a left hydraulic cylinder piston to move rightwards, and the hydraulic oil in a right chamber of the left telescopic mechanism 3 flows back into an oil cylinder of the control nipple 4 through the oil channel. Since the left hydraulic cylinder piston is fixedly connected to the central main body 1, all parts on the right side of the left hydraulic cylinder piston are driven to move rightwards in the process of moving rightwards, and the first step of pipe string traction by the robot is completed. Meanwhile, hydraulic oil flows into a right chamber of a right hydraulic cylinder body through an oil channel, the left operation nipple is fixed in position under the action of the left support mechanism 2 and the telescopic action of the left hydraulic cylinder, and the right operation nipple has no fixed support, so that the movement of a right hydraulic cylinder piston relative to a right hydraulic cylinder to the left is changed into the movement of the right hydraulic cylinder piston relative to the right hydraulic cylinder to the right, and the right operation nipple (except a right central main body 1) is driven to move to the right so as to prepare for next traction of the pipe string. The robot hydraulic control system in this case is as shown in FIG. 12: after the left support link assembly 22 is opened and the left support block 224 is tightly contacted with the well wall, the left positions 1YA, 3YA, and 5YA of the solenoid valves lose power simultaneously, the solenoid valves are in a middle position function, and the support link assembly 22 achieves a self-locking effect under the assistance of a matched hydraulic lock; then, the left position 7YA and the right position 7'YA of the three-position four-way solenoid valve of the left and right hydraulic cylinders are electrically connected, hydraulic oil enters the left chamber of the left hydraulic cylinder and the right chamber of the right hydraulic cylinder, the left hydraulic cylinder piston moves rightwards relatively to drive parts including the pipe string fixedly connected thereto to move rightwards, and the relative movement of the right hydraulic cylinder piston to the left is achieved by the relative movement of the right operation nipple to the right since the right operation nipple is not fixed by the support mechanism 2.

Figure 14:
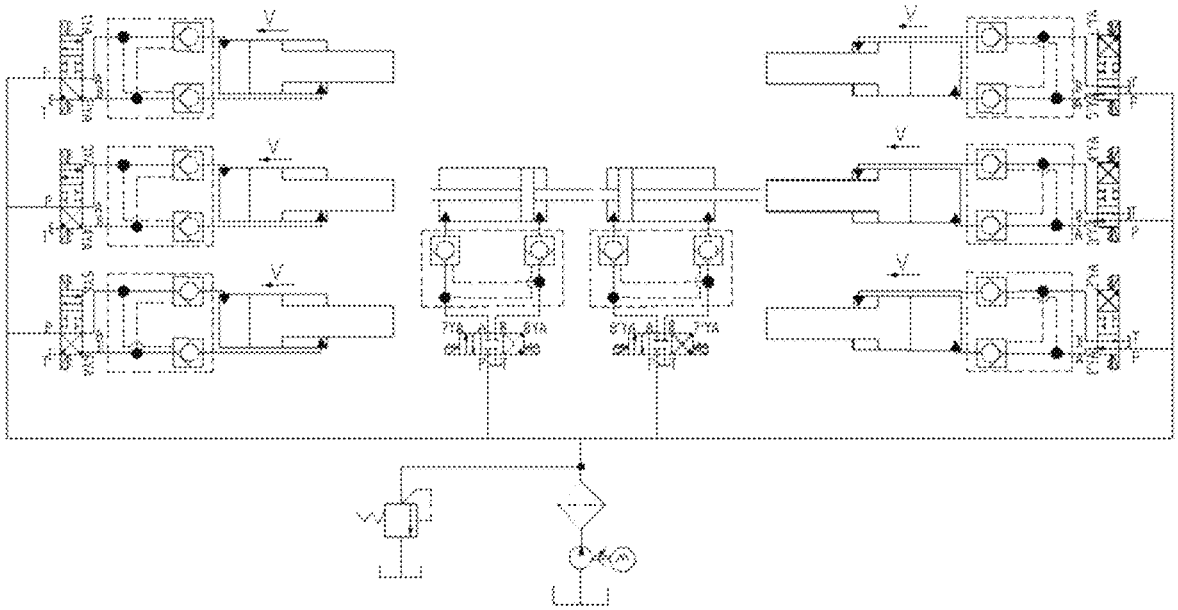
FIG. 14 is a hydraulic principle diagram of a self-adaptive traction robot in state d.

State d: A right support mechanism 2 in the right operation nipple is operating. Under the operation of a solenoid valve in the control nipple 4, hydraulic oil enters a plurality of right chambers of the right support cylinder bodies to push the pistons and the piston rods 213 of the corresponding right support cylinders to move leftwards, a plurality of groups of support link assemblies 22 are unfolded under the movement of the pistons and the piston rods 213 of the same group of right support cylinders, the opening degrees of the first links 223 of each group are the same, and a plurality of right support blocks 224 are simultaneously in close contact with the well wall/the casing wall. In this case, the support function of the right support mechanism 2 of the traction robot may be regarded as lifting off the well wall/pipe wall surface. Due to the friction force generated by the close contact between the support block 224 and the well wall/pipe wall, the right operation nipple of the traction robot (except the central main body 1) is fixed in the current position and remains unchanged relative to the wellbore. In addition, the solenoid valve in the control pup joint 4 controls hydraulic oil to enter the right chamber of the left support cylinder body 212 through an oil channel; in this case, the piston and the piston rod 213 of the left support cylinder move leftwards relative to the left support cylinder, and a plurality of left support link assemblies 22 start to be tightened when the pistons and the piston rods 213 of the same group of left support cylinders move leftwards until resetting is achieved. The robot hydraulic control system in this case is as shown in FIG. 14: after the telescopic mechanism 3 completes the first pipe string traction operation, the left position 7YA and the right position 7'YA of the three-position four-way solenoid valve lose power and return to the middle position function; then, the right positions 2YA, 4YA, and 6YA of the three-position four-way solenoid valve are electrically connected, the right chamber of the left support mechanism 2 is filled with liquid and the left chamber is returned with oil, and the piston and the piston rod 213 of the left support cylinder move leftwards to drive the support link assembly 22 to reset; the left positions 1'YA, 3'YA, 5'YA of the three-position four-way solenoid valve are electrically connected, and the piston and the piston rod 213 of the right support cylinder move to drive the right support link assembly 22 to open and clamp the well wall.

Figure 16:
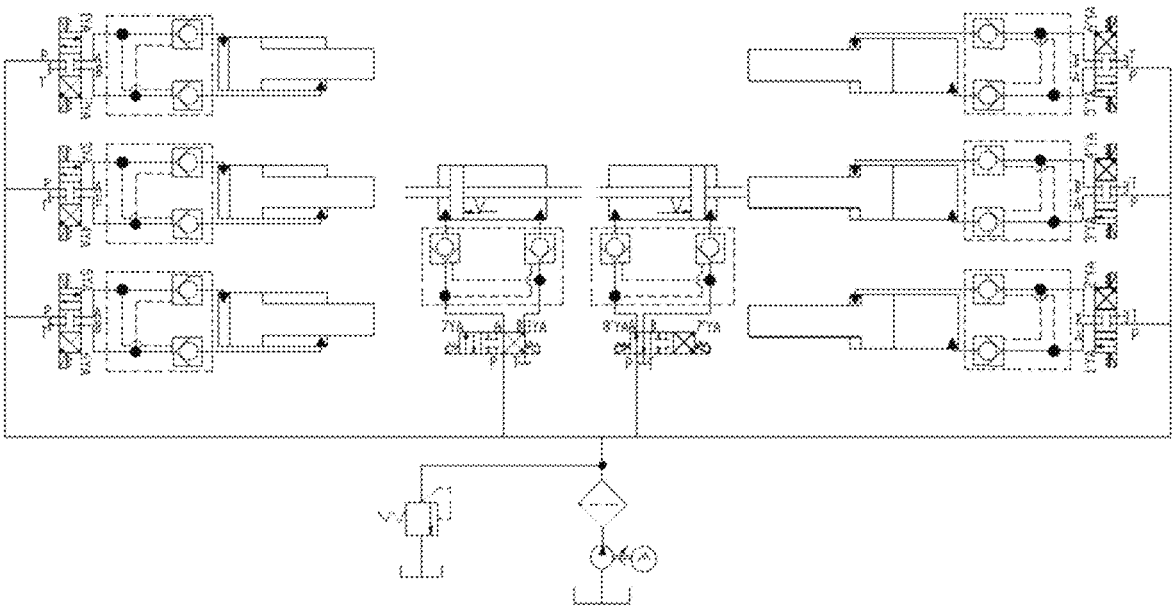
FIG. 16 is a hydraulic principle diagram of a self-adaptive traction robot in state e.
Figure 17:
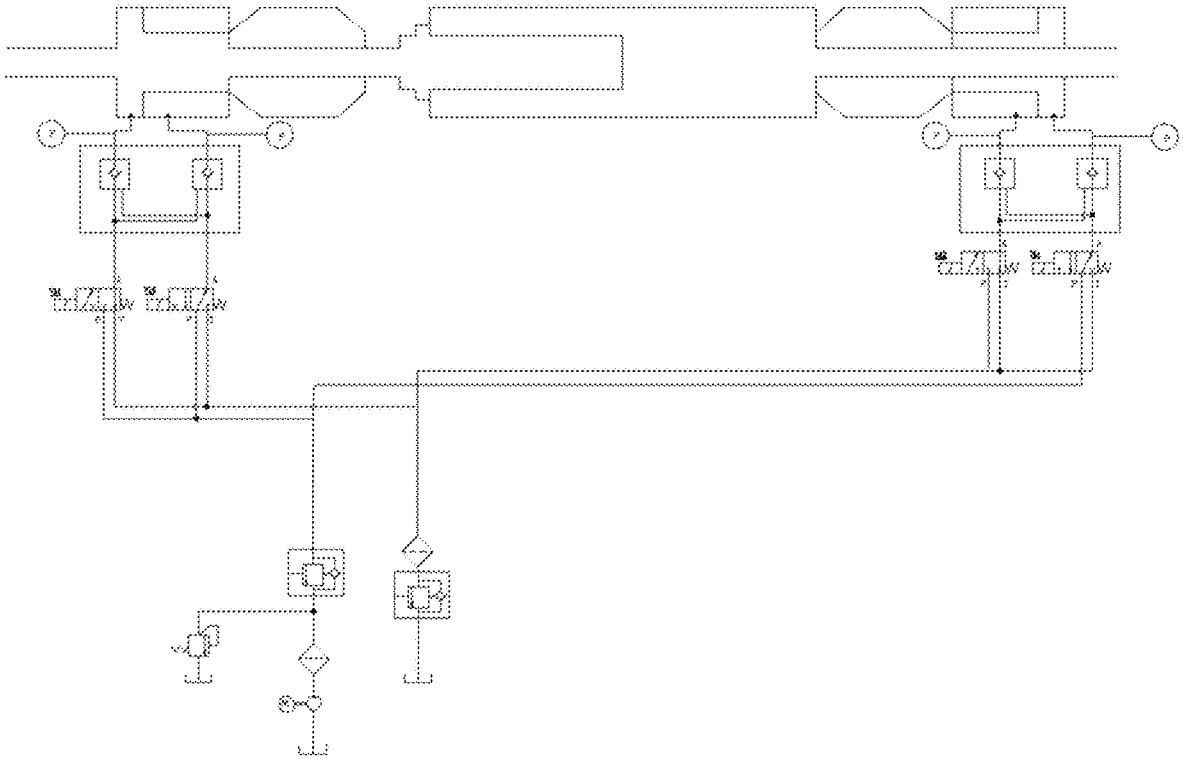
FIG. 17 is a structural diagram of a hydraulic system of a self-adaptive traction robot.
Figure 18:
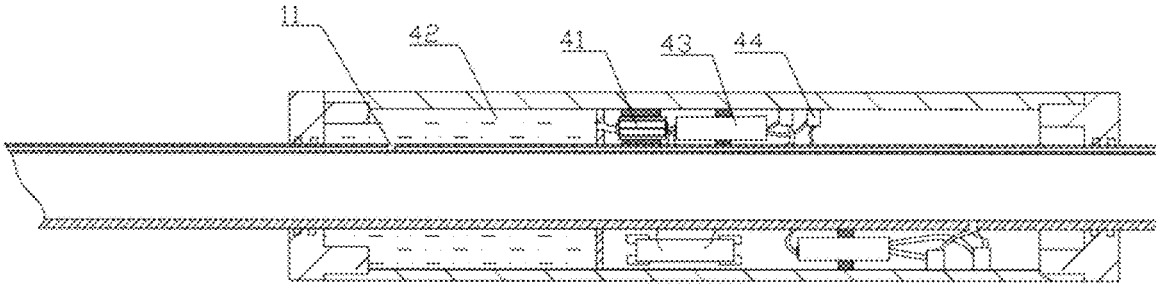
FIG. 18 is a cross-sectional view of a control nipple.
Figure 19:
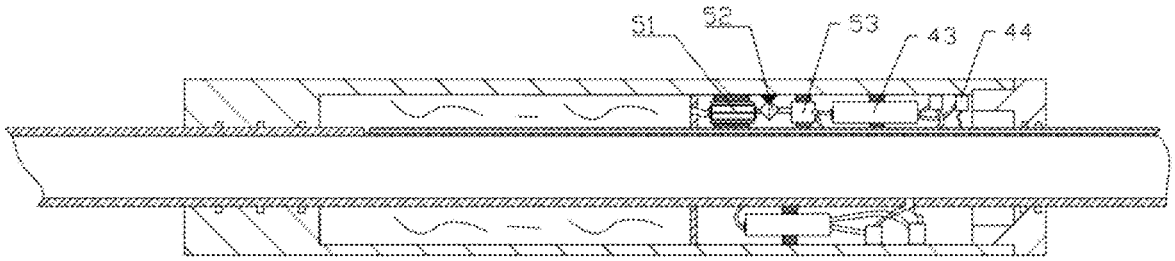
FIG. 19 is a cross-sectional view of a hydraulic nipple.

State e: With the assistance of the right support mechanism 2, the robot performs the second traction operation. When the right support mechanism performs support operation, solenoid valves for controlling the left and right telescopic mechanism 3 in the control nipple 4 start to work simultaneously; and hydraulic oil flows into the left chamber of the right hydraulic cylinder body through the oil channel, the right hydraulic cylinder piston moves rightwards relative to the right hydraulic cylinder, all parts on the left side of the right hydraulic cylinder piston move rightwards together with the right hydraulic cylinder piston, and the second pipe string traction is achieved. Meanwhile, hydraulic oil flows into a right chamber of a left hydraulic cylinder body through a hydraulic oil channel, the right operation nipple is fixed in position under the action of the right support mechanism 2 and the telescopic action of the right hydraulic cylinder, and the left operation nipple has no fixed support, so that the movement of a left hydraulic cylinder piston relative to a left hydraulic cylinder to the left is changed into the movement of the left hydraulic cylinder piston relative to the left hydraulic cylinder to the right, and the left operation nipple (except a left central main body 1) is driven to move to the right. The robot hydraulic control system in this case is as shown in FIG. 16: after the right support mechanism 2 clamps the well wall, the left positions 1'YA, 3'YA, and 5'YA of the three-position four-way solenoid valve lose power and return to the middle position function, and the left support mechanism 2 is self-locked with a hydraulic lock to stably clamp the well wall; then, the right position 8YA and the left position 8'YA of the three-position four-way solenoid valve are electrically connected, and the left hydraulic cylinder piston moves leftwards relatively; however, the robot is not fixed, the relative movement is completed through the rightward movement of the left operation nipple, the right operation nipple is fixed by the right support mechanism 2, and the right hydraulic cylinder piston moves rightwards to drive the integrally fixedly connected pipe string to move rightwards, so that second traction is completed.

By repeating actions b to e, the present invention can assist the traction robot in cyclical traction of the pipe string operation.

Figure 8:
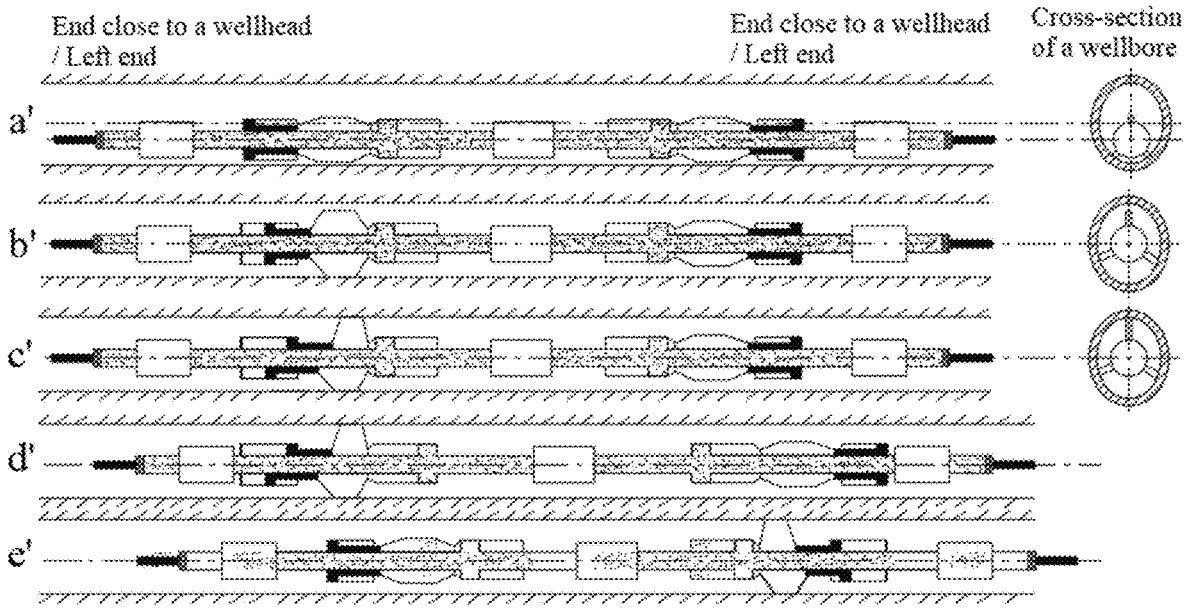
FIG. 8 is a schematic diagram of the working of a self-adaptive traction robot adapting to wellbore deformation under the action of a support mechanism.

When the wellbore or the casing is deformed, the movement principle of the traction robot is shown in FIG. 8:

State a': When the robot is stationary in the non-straight section of the wellbore, the support mechanism 2 of the traction robot is in a reset state. A piston and a piston rod 213 of a left support cylinder of a left support mechanism 2 in a left operation nipple are positioned at a left end of a left support cylinder, and a right end of the left support cylinder is empty to provide a chamber for hydraulic oil; a first link 223 is tightened as the piston and the piston rod 213 of the support cylinder are placed to the left, and then the entire support link assembly 22 is in a tightened state. A left hydraulic cylinder in a left telescopic mechanism 3 is placed right at a hydraulic cylinder piston fixed to a central main body 1, and two control nipples 4 are connected to the central main body 1 of two operation nipples without relative sliding and rotation. The right operation nipples are symmetrically distributed for the control nipple 4, and have the same function and working principle. The hydraulic control system is the same as that in FIG. 10. However, since the cross section of the wellbore is deformed, a plurality of groups of support arms are opened at the same angle, the support arms cannot be contacted with the well wall. In this case, whether the robot has effective displacement under the condition that the support mechanism 2 is not in complete contact is analyzed by monitoring the data of a displacement sensor in the telescopic mechanism 3. If normal pipe string traction is achieved, the working state is the same as that in the FIG. 7. If the displacement of the displacement sensor in the hydraulic cylinder is invalid under the condition that the support arm is not in complete contact, the data of the high-precision pressure sensor in the support arms are collected and observed, and the lowest value of the existing pressure data is selected when the movement of a single first link 223 is controlled according to the on-site construction requirements. When the support link assembly 22 with pressure reaches the lowest pressure, the support link assembly 22 with the existing pressure data is self-locked, and the hydraulic signal of the minimum group of pressure data is continued to be controlled until the first link 223 of this group opens to form a good contact with the pipe wall and the displacement sensor in the hydraulic cylinder has an effective displacement.

State b': A left support mechanism 2 in the left operation nipple is operating. Two or more solenoid valves in the control nipple 4 work simultaneously, and control hydraulic oil to enter a plurality of chambers of the left support cylinder body 212 of the left operation nipple along a plurality of oil inlets, so that pistons and piston rods 213 of a plurality of left support cylinders are pushed to move rightwards by the same stroke simultaneously. In this case, two or more left support link assemblies 22 are opened under the movement of a piston and a piston rod 213 of a correspondingly connected left support cylinder, the opening degree of the first links 223 in each left support link assembly is the same, and a plurality of left support blocks 224 are in close contact with the well wall or the casing wall. In this case, the support function of the left support mechanism 2 of the traction robot may be regarded as lifting off the well wall/pipe wall surface. Due to the friction force generated by the close contact between the support block 224 and the well wall/pipe wall, the left operation nipple of the traction robot (except the central main body 1) is fixed in the current position and remains unchanged relative to the wellbore. The hydraulic control system is the same as that in FIG. 10. However, since the cross section of the wellbore is deformed, a plurality of groups of support arms are opened at the same angle, the support arms cannot be contacted with the well wall. In this case, whether the robot has effective displacement under the condition that the support mechanism 2 is not in complete contact is analyzed by monitoring the data of a displacement sensor in the telescopic mechanism 3. If normal pipe string traction is achieved, the working state is the same as that in the FIG. 7. If the displacement of the displacement sensor in the hydraulic cylinder is invalid under the condition that the support arm is not in complete contact, as shown in the state of FIG. 8, c and the subsequent movement states continue.

Figure 13:
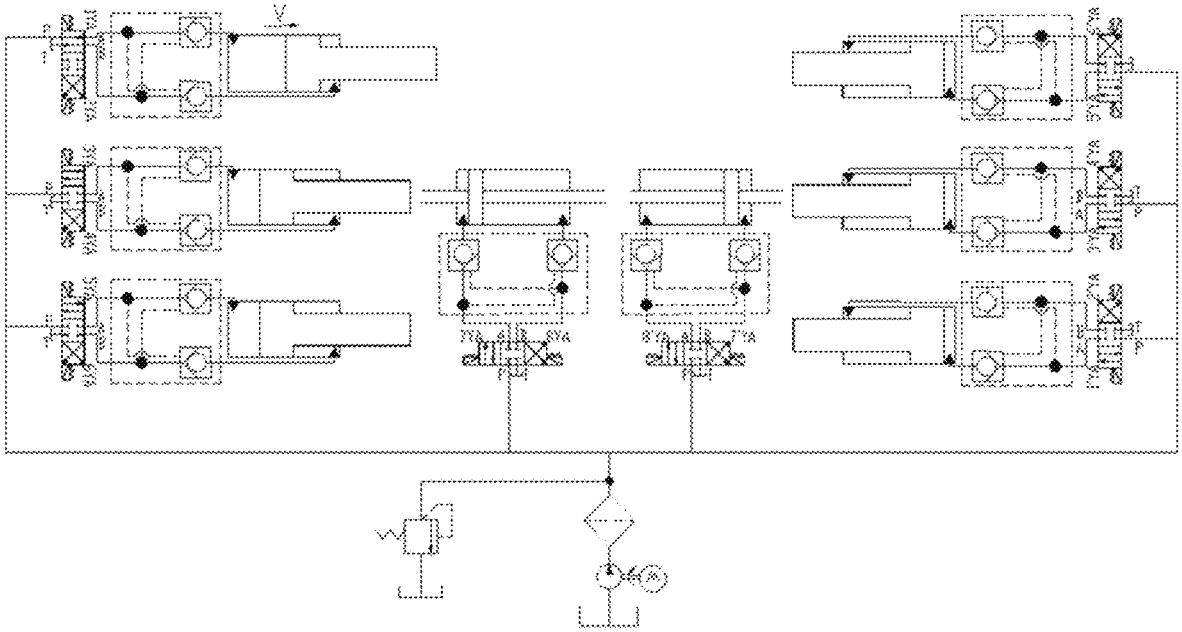
FIG. 13 is a hydraulic principle diagram of a self-adaptive traction robot in state c'.

State c': With the assistance of the left support mechanism 2, the robot performs the first traction operation. When the left support mechanism 2 performs support operation, solenoid valves for controlling left and right telescopic mechanisms 3 in the control nipple 4 start to work simultaneously; hydraulic oil flows into a left chamber of a left hydraulic cylinder body through a hydraulic oil channel to push a left hydraulic cylinder piston to move rightwards, and the hydraulic oil in a right chamber of the left telescopic mechanism 3 flows back into an oil cylinder of the control nipple 4 through the hydraulic oil channel. Since the left hydraulic cylinder piston is fixedly connected to the central main body 1, all parts on the right side of the left hydraulic cylinder piston are driven to move rightwards in the process of moving rightwards, and the first step of pipe string traction by the robot is completed. Meanwhile, hydraulic oil flows into a right chamber of a right hydraulic cylinder body through an oil channel, the left operation nipple is fixed in position under the action of the left support mechanism 2 and the telescopic action of the left hydraulic cylinder, and the right operation nipple has no fixed support, so that the movement of a right hydraulic cylinder piston relative to a right hydraulic cylinder to the left is changed into the movement of the right hydraulic cylinder piston relative to the right hydraulic cylinder to the right, and the right operation nipple (except a right central main body 1) is driven to move to the right so as to prepare for next traction of the pipe string. If the displacement of the displacement sensor in the hydraulic cylinder is invalid under the condition that the support arm is not in complete contact, the data of the high-precision pressure sensor in the support arms are collected and observed, and the lowest value of the existing pressure data is selected when the movement of a single first link 223 is controlled according to the on-site construction requirements. When the support link assembly 22 with pressure reaches the lowest pressure, the plurality of support link assemblies 22 with existing pressure data are self-locked, as shown in FIG. 13: 3YA and 5YA lose power, and 1YA is continuously started, so that this group of first links 223 are opened to form good contact with the pipe wall until the pressure sensors in this group of support blocks 224 detect effective pressure signals, and the minimum pressures are divided multiple times to adjust the opening and closing conditions of different support link assemblies 22 until effective displacement occurs in the displacement sensor in the hydraulic cylinder.

Figure 15:
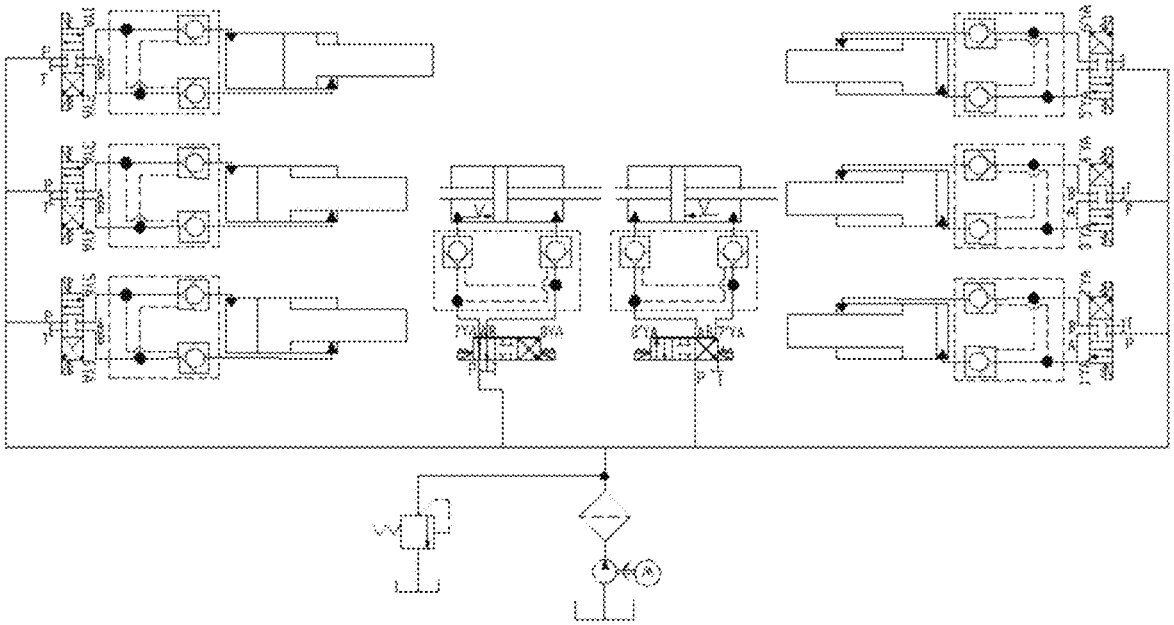
FIG. 15 is a hydraulic principle diagram of a self-adaptive traction robot in state d'.

State d': A right support mechanism 2 in the right operation nipple is operating. Under the operation of a solenoid valve in the control nipple 4, hydraulic oil enters a plurality of right chambers of the right support cylinder bodies to push the pistons and the piston rods 213 of the corresponding right support cylinders to move leftwards, a plurality of groups of right support link assemblies 22 are unfolded under the movement of the pistons and the piston rods 213 of the same group of right support cylinders, the opening degrees of the first links 223 of each group are the same, and a plurality of right support blocks 224 are simultaneously in close contact with the well wall/the casing wall. In this case, the support function of the right support mechanism 2 of the traction robot may be regarded as lifting off the well wall/pipe wall surface. Due to the friction force generated by the close contact between the support block 224 and the well wall/pipe wall, the right operation nipple of the traction robot (except the central main body 1) is fixed in the current position and remains unchanged relative to the wellbore. In addition, the solenoid valve in the control pup joint 4 controls hydraulic oil to enter the right chamber of the left support cylinder body 212 through an oil channel; in this case, the piston and the piston rod 213 of the left support cylinder move leftwards relative to the left support cylinder, and a plurality of left support link assemblies 22 start to be tightened when the pistons and the piston rods 213 of the same group of left support cylinders move leftwards until resetting is achieved. The robot hydraulic control system in this case is as shown in FIG. 15: after the pressure value of the pressure sensor monitored by the system reaches the static friction force required by the well wall and the support block 224, the left position 1YA of the solenoid valve loses power, and 1YA, 5YA, and 7YA of the solenoid valve are in the middle position function, and the support link assembly 22 achieves a self-locking effect under the assistance of a matched hydraulic lock; then, the left position 7YA and the right position 7'YA of the three-position four-way solenoid valve of the left and right hydraulic cylinders are electrically connected, hydraulic oil enters the left chamber of the left hydraulic cylinder and the right chamber of the right hydraulic cylinder, the left hydraulic cylinder piston moves rightwards relatively to drive parts including the pipe string fixedly connected thereto to move rightwards, and the relative movement of the right hydraulic cylinder piston to the left is achieved by the relative movement of the right operation nipple to the right since the right operation nipple is not fixed by the support mechanism 2.

State e': With the assistance of the right support mechanism 2, the robot performs the second traction operation. When the right support mechanism performs support operation, solenoid valves for controlling the left and right telescopic mechanism 3 in the control nipple 4 start to work simultaneously; and hydraulic oil flows into the left chamber of the right hydraulic cylinder body through the oil channel, the right hydraulic cylinder piston moves rightwards relative to the right hydraulic cylinder, all parts on the left side of the right hydraulic cylinder piston move rightwards together with the right hydraulic cylinder piston, and the second pipe string traction is achieved. Meanwhile, hydraulic oil flows into a right chamber of a left hydraulic cylinder body through a hydraulic oil channel, the right operation nipple is fixed in position under the action of the right support mechanism 2 and the telescopic action of the right hydraulic cylinder, and the left operation nipple has no fixed support, so that the movement of a left hydraulic cylinder piston relative to a left hydraulic cylinder to the left is changed into the movement of the left hydraulic cylinder piston relative to the left hydraulic cylinder to the right, and the left operation nipple (except a left central main body 1) is driven to move to the right.

By repeating actions b' to e', the present invention can assist the traction robot in cyclically traction of the pipe string operation.

Figure 9:
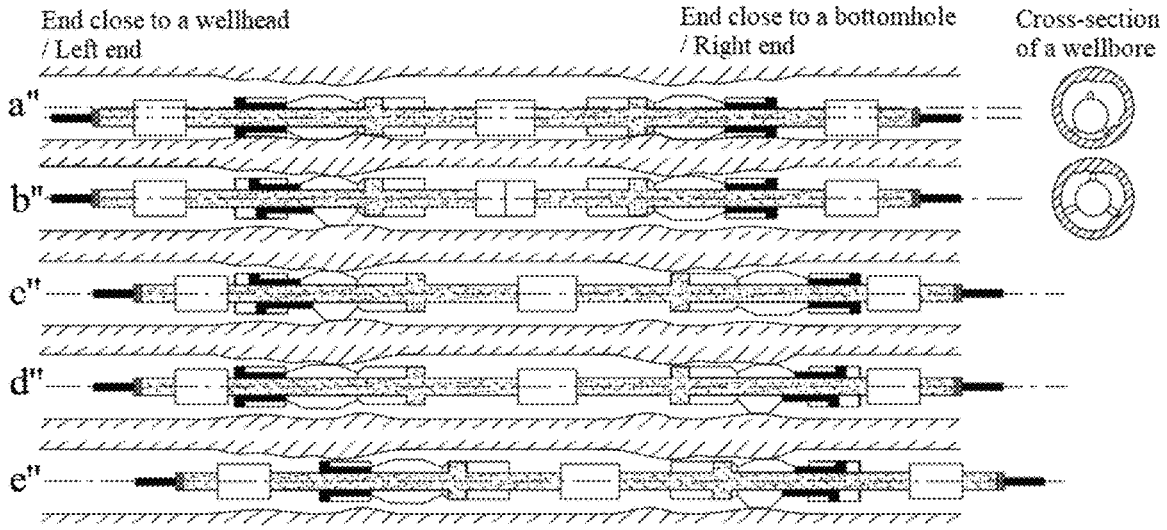
FIG. 9 is a schematic diagram of the working of a self-adaptive traction robot adapting to an irregular wellbore surface under the action of a support mechanism.

When the wellbore or the casing is deformed, the movement principle of the traction robot is shown in FIG. 9:

State a": When the robot is stationary in the non-straight section of the wellbore, the support mechanism 2 of the traction robot is in a reset state. A piston and a piston rod 213 of a left support cylinder of a left support mechanism 2 in a left operation nipple are positioned at a left end of a left support cylinder, and a right end of the left support cylinder is empty to provide a chamber for hydraulic oil; a first link 223 is tightened as the piston and the piston rod 213 of the support cylinder are placed to the left, and then the entire support link assembly 22 is in a tightened state. A left hydraulic cylinder in a left telescopic mechanism 3 is placed right at a hydraulic cylinder piston fixed to a central main body 1, and two control nipples 4 are connected to the central main body 1 of two operation nipples without relative sliding and rotation. The right operation nipples are symmetrically distributed for the control nipple 4, and have the same function and working principle.

State b": A left support mechanism 2 in the left operation nipple is operating. Two or more solenoid valves in the control nipple 4 work simultaneously, and control hydraulic oil to enter a plurality of chambers of the left support cylinder body 212 of the left operation nipple along a plurality of oil inlets, so that pistons and piston rods 213 of a plurality of left support cylinders are pushed to move rightwards by the same stroke simultaneously. In this case, two or more left support link assemblies 22 are opened under the movement of a piston and a piston rod 213 of a correspondingly connected left support cylinder, the opening degree of the first links 223 in each left support link assembly is the same, and a plurality of left support blocks 224 are in close contact with the well wall or the casing wall. In this case, the support function of the left support mechanism 2 of the traction robot may be regarded as lifting off the well wall/pipe wall surface. Due to the friction force generated by the close contact between the support block 224 and the well wall/pipe wall, the left operation nipple of the traction robot (except the central main body 1) is fixed in the current position and remains unchanged relative to the wellbore.

State c": With the assistance of the left support mechanism 2, the robot performs the first traction operation. When the left support mechanism 2 performs support operation, solenoid valves for controlling left and right telescopic mechanisms 3 in the control nipple 4 start to work simultaneously; hydraulic oil flows into a left chamber of a left hydraulic cylinder body through a hydraulic oil channel to push a left hydraulic cylinder piston to move rightwards, and the hydraulic oil in a right chamber of the left telescopic mechanism 3 flows back into an oil cylinder of the control nipple 4 through the hydraulic oil channel. Since the left hydraulic cylinder piston is fixedly connected to the central main body 1, all parts on the right side of the left hydraulic cylinder piston are driven to move rightwards in the process of moving rightwards, and the first step of pipe string traction by the robot is completed. Meanwhile, hydraulic oil flows into a right chamber of a right hydraulic cylinder body through an oil channel, the left operation nipple is fixed in position under the action of the left support mechanism 2 and the telescopic action of the left hydraulic cylinder, and the right operation nipple has no fixed support, so that the movement of a right hydraulic cylinder piston relative to a right hydraulic cylinder to the left is changed into the movement of the right hydraulic cylinder piston relative to the right hydraulic cylinder to the right, and the right operation nipple (except a right central main body 1) is driven to move to the right so as to prepare for next traction of the pipe string.

State d": A right support mechanism 2 in the right operation nipple is operating. Under the operation of a solenoid valve in the control nipple 4, hydraulic oil enters a plurality of right chambers of the right support cylinder bodies to push the pistons and the piston rods 213 of the corresponding right support cylinders to move leftwards, a plurality of groups of right support link assemblies 22 are unfolded under the movement of the pistons and the piston rods 213 of the same group of right support cylinders, the opening degrees of the first links 223 of each group are the same, and a plurality of right support blocks 224 are simultaneously in close contact with the well wall/the casing wall. In this case, the support function of the right support mechanism 2 of the traction robot may be regarded as lifting off the well wall/pipe wall surface. Due to the friction force generated by the close contact between the support block 224 and the well wall/pipe wall, the right operation nipple of the traction robot (except the central main body 1) is fixed in the current position and remains unchanged relative to the wellbore. In addition, the solenoid valve in the control pup joint 4 controls hydraulic oil to enter the right chamber of the left support cylinder body 212 through an oil channel; in this case, the piston and the piston rod 213 of the left support cylinder move leftwards relative to the left support cylinder, and a plurality of left support link assemblies 22 start to be tightened when the pistons and the piston rods 213 of the same group of left support cylinders move leftwards until resetting is achieved.

State e": With the assistance of the right support mechanism 2, the robot performs the second traction operation. When the right support mechanism performs support operation, solenoid valves for controlling the left and right telescopic mechanism 3 in the control nipple 4 start to work simultaneously; and hydraulic oil flows into the left chamber of the right hydraulic cylinder body through the oil channel, the right hydraulic cylinder piston moves rightwards relative to the right hydraulic cylinder, all parts on the left side of the right hydraulic cylinder piston move rightwards together with the right hydraulic cylinder piston, and the second pipe string traction is achieved. Meanwhile, hydraulic oil flows into a right chamber of a left hydraulic cylinder body through a hydraulic oil channel, the right operation nipple is fixed in position under the action of the right support mechanism 2 and the telescopic action of the right hydraulic cylinder, and the left operation nipple has no fixed support, so that the movement of a left hydraulic cylinder piston relative to a left hydraulic cylinder to the left is changed into the movement of the left hydraulic cylinder piston relative to the left hydraulic cylinder to the right, and the left operation nipple (except a left central main body 1) is driven to move to the right.

By repeating actions b" to e", the present invention can assist the traction robot in cyclically traction of the pipe string operation.

The present invention can achieve that a support mechanism can adapt to wellbore changes under complex conditions, so that a robot is in good contact with a pipe wall under casing deformation, and the entire structure of the robot is assisted to cooperatively work to achieve maximization of the working efficiency. The control method of the robot support mechanism provided by the present invention is simple in principle, and is easy to implement and verify. The electronic components involved are easy to obtain or produce in the market, which can save a lot of engineering costs. The adopted electro-hydraulic control system has a fast response; and a hydraulic lock is also provided to achieve self-locking of the mechanism. The robot support mechanism has a simple structure, is convenient to assemble, disassemble and maintain, and can save a large amount of labor cost.

The present invention has been described in detail with reference to the accompanying drawings and embodiments. However, the present invention is not limited to the foregoing embodiments. Various changes can be made within the knowledge of those of ordinary skill in the art without departing from the gist of the present invention. Therefore, the present invention is not limited to the particular embodiments disclosed. All embodiments falling within the scope of claims of the present application fall within the protection scope of the present invention.

What is claimed is:

1. A support mechanism of a self-adaptive traction robot for a complex wellbore, comprising a left operation nipple, a control nipple, a hydraulic nipple, and a right operation nipple, wherein the left operation nipple and the right operation nipple are axially symmetrical relative to the control nipple and have a same structural function, two ends of the control nipple are respectively connected to the left operation nipple and the right operation nipple, the left operation nipple comprises a central main body, a support mechanism, a telescopic mechanism, and a hydraulic nipple, the support mechanism comprises a support cylinder assembly and a support link assembly, the support cylinder assembly comprises a support cylinder end cover, a support cylinder body, two or more than two pistons and piston rods, and a support cylinder partition, the support cylinder body comprises support hydraulic chambers with a same number as pistons and piston rods and a same stroke and volume, and a number of the support link assemblies is consistent with that of pistons and piston rods; the support cylinder partition is mounted in a groove in the support cylinder body, and the support cylinder body is divided into a plurality of support hydraulic chambers with equal stroke and volume by the support cylinder partition;

a piston and a piston rod are mounted on an end face of the support cylinder body in a matched mode, and a piston and a piston rod are mounted in each of the support hydraulic chambers;

the support cylinder end cover is in threaded fit with an end face of the support cylinder body and is in contact with the support cylinder partition, so as to limit a position of the support cylinder partition; the support link assemblies are evenly arranged on the robot circumferentially, each of the support link assemblies comprises a short link base, a long link base, a first link, a support block, a second link, a third link, a support surface, and a pull rod, the short link base is in threaded connection with a part of a piston and a piston rod extending out of the support cylinder body, the short link base is hinged to the first link, the first link is hinged to the support block and the third link, the other end of the support block is hinged to the second link, the second link is hinged to a right end of the long link base, the third link is hinged to a left end of the long link base, the long link base is fixedly connected to the telescopic mechanism, and two ends of the pull rod are respectively fixed to the support cylinder body and the telescopic mechanism with threads; a micro pressure sensor is mounted in the support block; a plurality of oil channels are distributed in an annulus of the central main body, the central main body penetrates through the support mechanism, the telescopic mechanism, the control nipple, and the hydraulic nipple, the central main body is assembled with the support mechanism, and there is no relative sliding or rotation between the central main body and the support mechanism; a displacement sensor is arranged in the telescopic mechanism; the control nipple is equipped with a control circuit and wires, a micro motor, a hydraulic oil cylinder, two O-shaped middle-position functions for controlling the telescopic mechanism, a three-position four-way solenoid valve, and a hydraulic lock consisting of a plurality of one-way valves; and the hydraulic nipple is equipped with a plurality of O-shaped middle-position functions required by the support mechanism, a three-position four-way solenoid valve, a hydraulic lock consisting of a plurality of one-way valves, one micro hydraulic pump, one oil filter, and one relief valve.

2. A control method of a support mechanism of a self-adaptive traction robot for a complex wellbore used to control the support mechanism of the self-adaptive traction robot for the complex wellbore according to claim 1, comprising the following steps:

S1: setting basic data, wherein the basic data comprises an opening time and an action cycle of a solenoid valve, a starting threshold and a maximum threshold of a hydraulic cylinder in a support cylinder assembly, and an initial starting time coefficient of the solenoid valve;

S2: judging whether a pressure of the hydraulic cylinder in the support cylinder assembly reaches the maximum threshold, if not, proceeding to a next operation, and if so, ending the operation;

S3: collecting a pressure difference before and after each solenoid valve, and calculating and storing data of a piston stroke and thrust of the support cylinder assembly;

S4: fitting and calculating a derivative of a piston stroke-thrust curve according to the data of the piston stroke and thrust;

S5: judging whether a slope of the derivative of the piston stroke-thrust curve is less than a first slope, if so, indicating that a support link assembly and a wellbore wall are in a clearance stage, and if not, indicating that a support link assembly and a wellbore wall are in a contact state or a lifting stage;

S6: further judging whether a slope of the derivative of the piston stroke-thrust curve is less than a second slope, if so, indicating that a support link assembly and a wellbore wall are in a lifting stage, and if not, indicating that a support link assembly and a wellbore wall are in a contact state;

S7: adjusting a time coefficient of a hydraulic cylinder control cycle according to a state between each of the support link assemblies and the wellbore wall, that is, opening a corresponding solenoid valve for a specified time; and S8: calculating a thrust of the hydraulic cylinder, judging whether a target thrust has been reached, if not, returning to the step S2 and continuing subsequent steps until the target thrust is reached; if so, ending the control.

3. The control method of the support mechanism of the self-adaptive traction robot for the complex wellbore according to claim 2, wherein a specific method for fitting and calculating the derivative of the piston stroke-thrust curve in the S4 is as follows:

$$Q = C_v(p_w - p_{ci})\sqrt{\frac{\rho}{SG}},$$

wherein Q is a flow rate of the solenoid valve, $C_v$ is a coefficient of the solenoid valve, which is determined by an indoor experiment after the solenoid valve is processed, $p_w$ is a working pressure of a hydraulic system, $p_d$ is a pressure of an $i^{th}$ hydraulic cylinder, ρ is a hydraulic oil density, and SG is a specific gravity of hydraulic oil; a calculation formula of a displacement of the hydraulic cylinder in one control cycle:

$$d_x = \frac{kQdt}{S},$$

wherein k is a time coefficient selected from k0, k1, and k2, dt is an opening time of the solenoid valve in a control cycle, dx is a displacement of a piston of the hydraulic cylinder in one control cycle, and S is an area of a piston of the hydraulic cylinder; and a calculation formula of a thrust of the hydraulic cylinder is as follows:

$$p_{ci} = \frac{F}{S},$$

wherein F is the thrust, and the derivative of the piston stroke-thrust curve in a control cycle can be obtained according to the three formulas.

4. The control method of the support mechanism of the self-adaptive traction robot for the complex wellbore according to claim 3, wherein the solenoid valve is driven by a PWM signal with a certain duty cycle, a position and a pressure of a piston of the hydraulic cylinder in a control cycle are measured, a thrust of the piston is further calculated, a state of each thrust hydraulic cylinder is judged according to the slope, and the time coefficients k0, k1, and k2 of the device are adjusted according to the state of each hydraulic cylinder, namely the duty cycle of the PWM is adjusted.

* * * * *